US007007652B2

(12) United States Patent
Williams

(10) Patent No.: US 7,007,652 B2
(45) Date of Patent: Mar. 7, 2006

(54) VARIABLE DURATION VALVE TIMING CAMSHAFT

(75) Inventor: Danny Russell Williams, Highfields (AU)

(73) Assignee: Transtar Pacific Limited, Wanchai (HK)

( * ) Notice: Subject to any disclaimer, the term of this patent is extended or adjusted under 35 U.S.C. 154(b) by 9 days.

(21) Appl. No.: 10/934,285

(22) Filed: Sep. 3, 2004

(65) Prior Publication Data

US 2005/0034694 A1 Feb. 17, 2005

Related U.S. Application Data

(63) Continuation of application No. 10/399,801, filed as application No. PCT/AU01/01361 on Oct. 23, 2001, now Pat. No. 6,854,435.

(30) Foreign Application Priority Data

Oct. 23, 2000 (AU) ..... PR0931

(51) Int. Cl.
*F01L 1/04* (2006.01)

(52) U.S. Cl. ..... 123/90.6; 123/90.17; 123/90.27

(58) Field of Classification Search .. 123/90.15–90.18, 123/90.39–90.47; 74/53–55, 567, 568 R, 74/569, 25

See application file for complete search history.

(56) References Cited

U.S. PATENT DOCUMENTS

| | | | | |
|---|---|---|---|---|
| 1,527,456 A | | 2/1925 | DeJoe | 74/568 R |
| 1,757,046 A | | 5/1930 | Horine | 74/568 R |
| 1,798,185 A | | 3/1931 | Burnett | 164/55.1 |
| 3,144,009 A | | 8/1964 | Homer | 123/90 |
| 3,523,465 A | * | 8/1970 | Harrell | 74/568 R |
| 4,332,222 A | | 6/1982 | Papez | 123/90.17 |
| 4,522,085 A | | 6/1985 | Kane | 74/567 |
| 5,253,622 A | | 10/1993 | Bornstein et al. | 123/90.17 |
| 5,501,186 A | * | 3/1996 | Hara et al. | 123/90.16 |
| 5,671,706 A | | 9/1997 | Frost | 123/90 |

FOREIGN PATENT DOCUMENTS

| | | |
|---|---|---|
| DE | 19 24 114 A | 11/1970 |
| DE | 39 33 923 A1 | 4/1991 |
| DE | 44 03 426 A | 8/1994 |
| EP | 0 440 314 A2 | 8/1991 |
| FR | 2 485 622 | 12/1981 |
| WO | WO 95/00748 | 1/1995 |

* cited by examiner

*Primary Examiner*—Thomas Denion
*Assistant Examiner*—Ching Chang
(74) *Attorney, Agent, or Firm*—Woodcock Washburn, LLP

(57) ABSTRACT

A variable duration valve timing camshaft is disclosed. The camshaft has a shaft with fixed cam lobes and lobe modifying elements that are adapted to move outwardly as the rate of rotation of the camshaft increases thereby cooperating with the lobes to continuously increase the angular distance at constant radius of each fixed valve lobe's nose. The lobe modifying elements are further adapted to move inwards as the rate of rotation of the camshaft decreases thereby continuously decreasing the angular distance of constant radius of each fixed valve lobe's nose until it equals that of the fixed lobe. The lobe modifying elements are pivotally connected to the camshaft.

10 Claims, 7 Drawing Sheets

VARIABLE DURATION VALVE TIMING CAMSHAFT

CROSS-REFERENCE TO RELATED APPLICATIONS

This application is a continuation of U.S. application Ser. No. 10/399,801 filed Oct. 6, 2003 now U.S. Pat. No. 6,854,435, now allowed, which is a U.S. National Phase filing under 35 USC 371 based upon PCT Application No. PCT/AU01/01361, filed Oct. 23, 2001, which claims priority to Australian Provisional Application No. PR0931, filed Oct. 23, 2000.

FIELD OF THE INVENTION

This invention relates to camshafts for four stroke internal combustion engines. More particularly it relates to camshafts that cause engine speed variable timing duration of combustion chamber valves.

BACKGROUND OF THE INVENTION

Both petrol and diesel stroke engines typically use a camshaft to control the opening and closing of the engine's intake and exhaust valves. Normally the open period of the valves, usually referred to as the "duration" or "dwell", is fixed by the valve lobe shape or profile ground onto the lobe of the camshaft when it is manufactured. Normally, this profile cannot be varied without the physical replacement of the camshaft by another with a different profile ground onto its lobes.

On some engines that are described as having variable camshaft timing, the opening and closing points of the valves can be varied but the actual duration or dwell of the valve opening remains fixed. A conventional camshaft that provides a fixed amount of valve opening allows an engine to achieve maximum volumetric efficiency, and hence torque, at only one point in the engine's revolution range. The torque falls off on either side of this point.

A camshaft arrangement which allows the valve opening duration to be varied so as to maximise the torque throughout the engine's revolution range would be very desirable. This fact has long been realised by engine designers and much effort has been expended in the search of a mechanical variable duration system of valve timing. No successful system has been achieved for a mechanical continuously variable system of valve timing duration. Systems which are not continuously variable but operate on a two-stage principle, such as Honda's VTEC system, have been adopted and are highly successful. Much effort is being spent on investigating hydraulic, pneumatic and solenoid systems of variable duration valve timing. Although the main advantage of a variable duration timing camshaft is to improve the torque spread of an engine it could be used to provide throttle-free control of the engine's induction to minimise intake pumping losses and/or to achieve low exhaust emissions.

It has been proposed to use a camshaft having two closely spaced cam lobes in combination with a wider than normal follower, or tappet, that rides on both lobes simultaneously. A mechanism is provided so that the lobes can be aligned to give minimum duration or misaligned to give an increase in duration. If the misalignment does not exceed the angular distance of constant radius of the cam lobe's nose, the follower "sees" the constant radius area as a continuous surface. The main deficiency of these devices is that the useable duration range is limited to twice, measured in degrees of rotation of the crankshaft, that of the angular span of the constant radius at the lobe's nose. The nose is the region of maximum lift of the camshaft lobe. Any attempt to increase the duration past this angular distance results in the follower falling into the gap between the two lobe noses causing unacceptable noise and wear. There have been proposed solutions to this problem, but none have been commercially successful. There is a wide range of possible variations in lobe profiles, style of construction, even using lobes on two separate shafts, and methods of control and actuation of the duration change. However, none of these have provided a successful product.

It would be desirable to have an improved variable duration timing camshaft and even more desirable to have one that could be fitted after market.

SUMMARY OF THE INVENTION

This invention provides in one form a variable duration valve timing camshaft comprising:

a shaft with fixed cam lobes lobe modifying elements that are adapted to move outwardly as the rate of rotation of the camshaft increases thereby cooperating with the lobes to continuously increase the angular distance at constant radius of each fixed valve lobe's nose and wherein the lobe modifying elements are further adapted to move inwards as the rate of rotation of the camshaft decreases thereby continuously decreasing the angular distance of constant radius of each fixed valve lobe's nose until it equals that of the fixed lobe.

Preferably the lobe modifying elements are pivotally connected to the camshaft.

In an alternative form the invention provides an internal combustion engine having a variable duration valve timing camshaft as described above.

DETAILED DESCRIPTION OF THE INVENTION

Figure 1A:
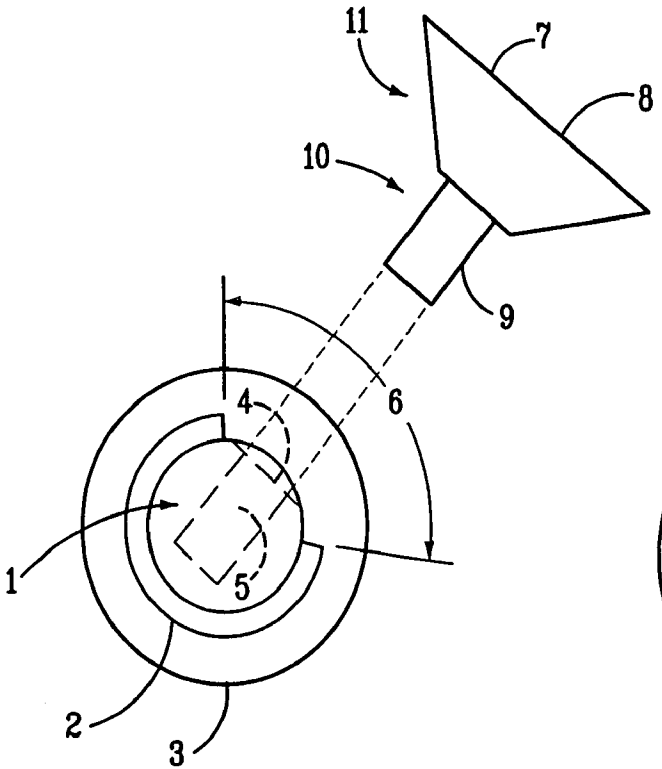
FIGS. 1(*a*), 1(*b*), 1(*c*), 1(*d*) and 1(*e*) are schematic views of the assembly of a camshaft.
Figure 1B:
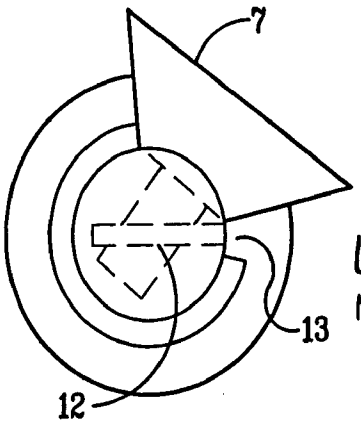
Figure 1C:
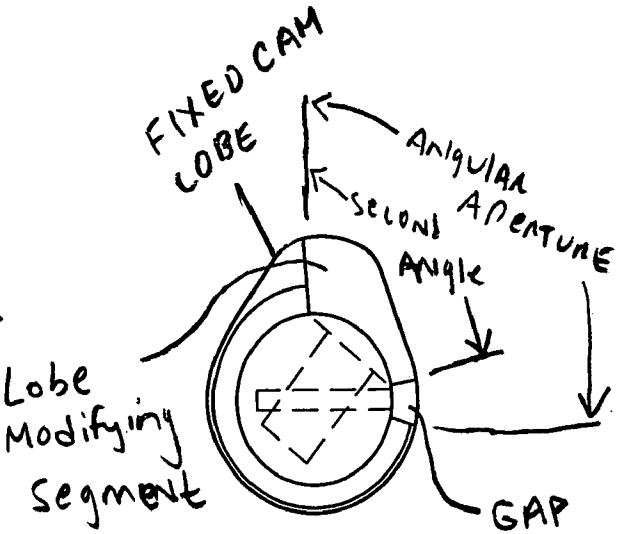
Figure 1D:
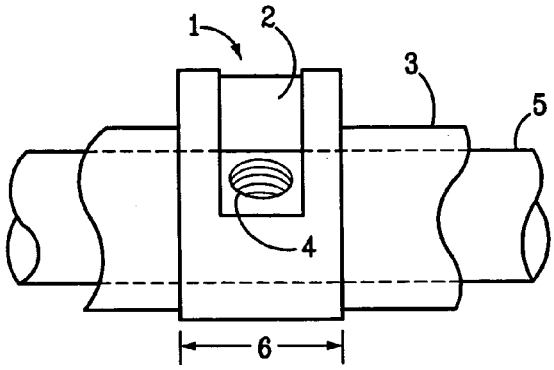
Figure 1E:
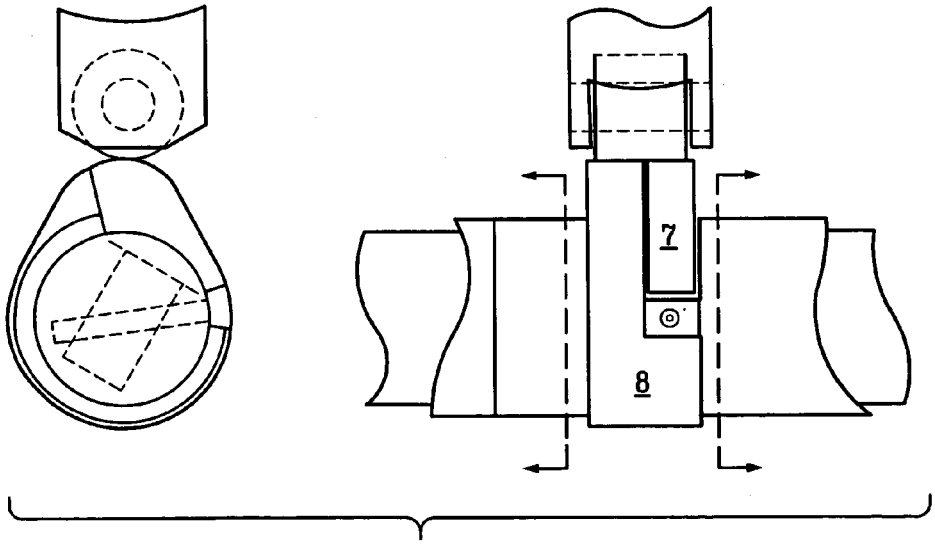
Figure 2B:
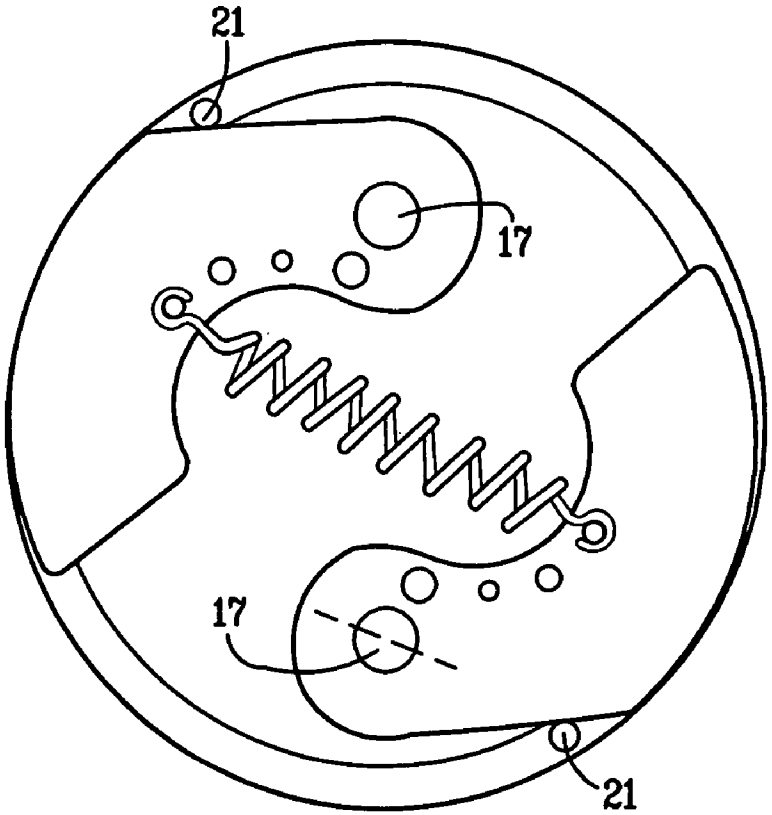
FIGS. 2(*a*), 2(*b*), 2(*c*), 2(*d*), 2(*e*), 2(*f*), and 2*g* are schematic views of the camshaft in open and closed positions.
Figure 2A:
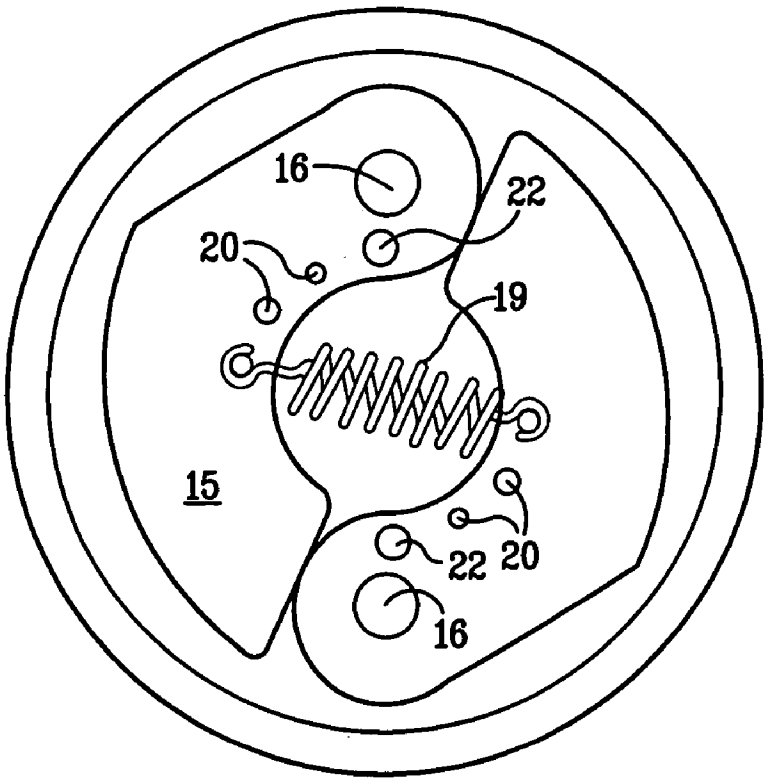
Figure 2C:
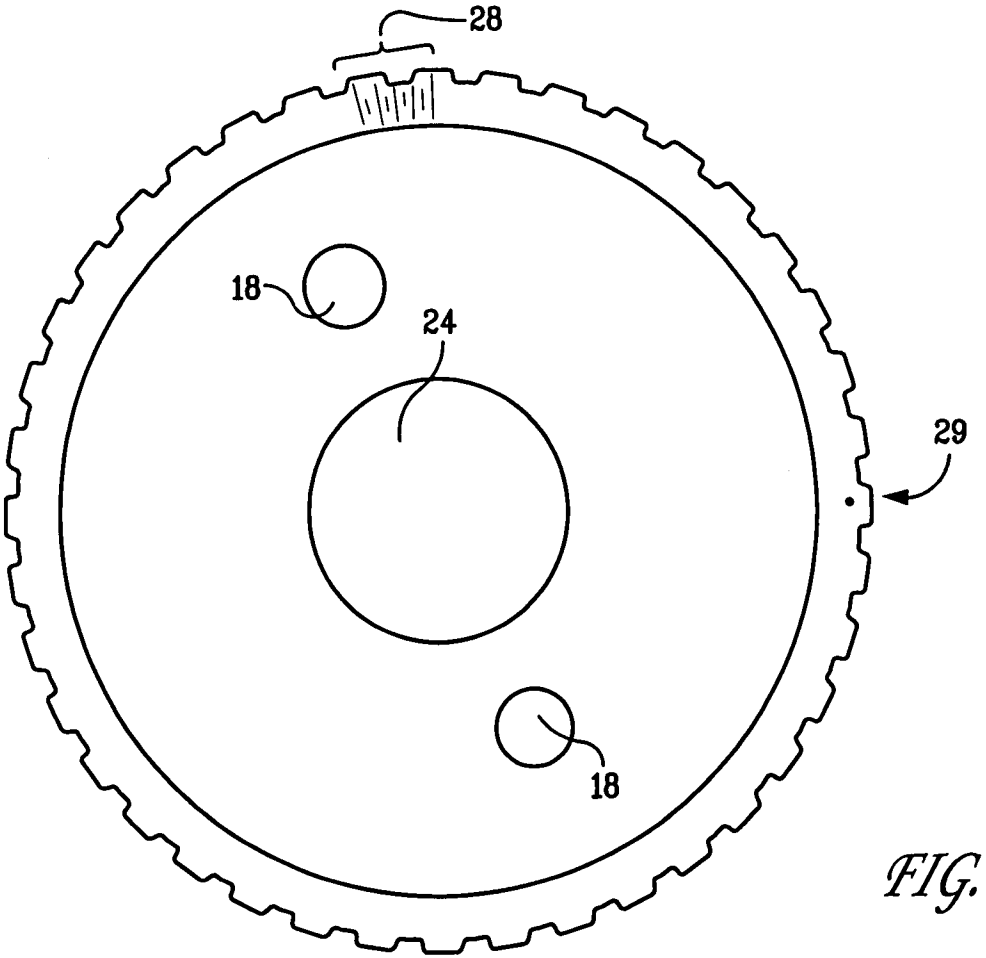
Figure 2E:
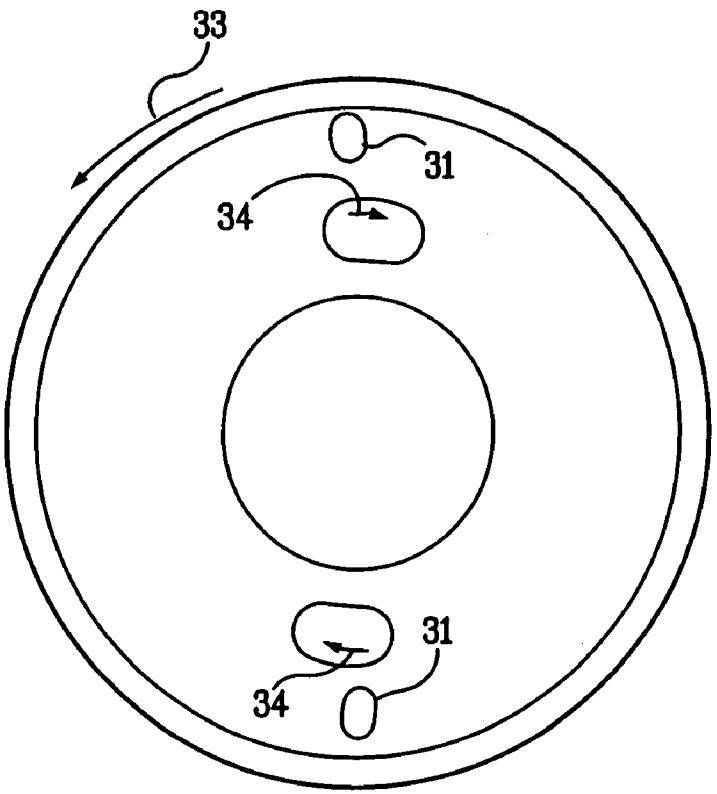
Figure 2D:
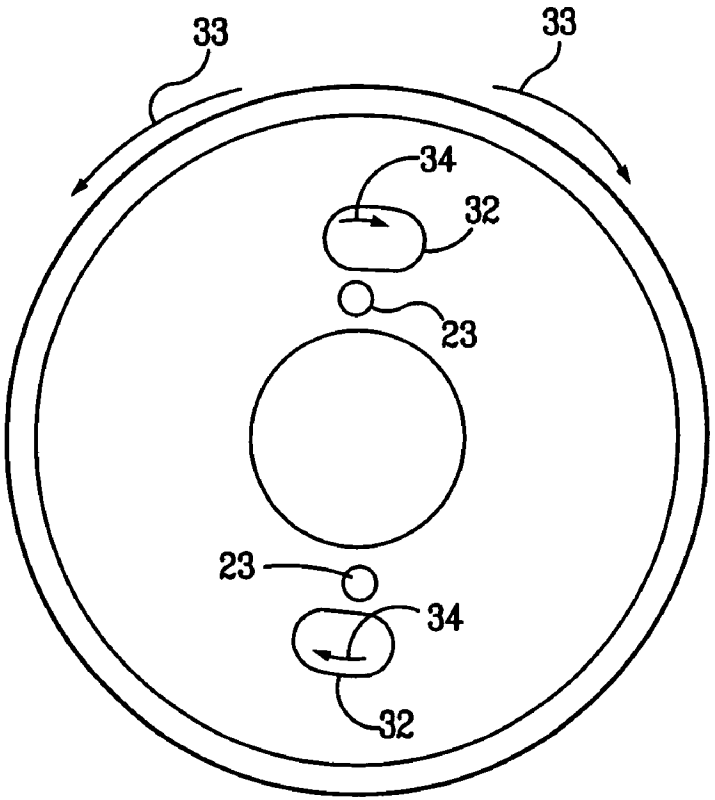
Figure 2G:
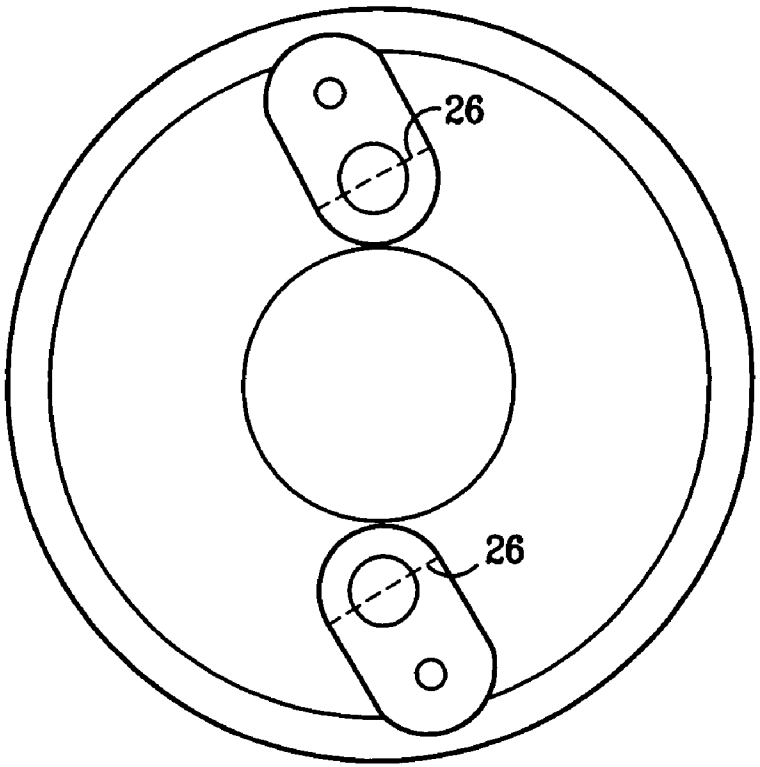
Figure 2F:
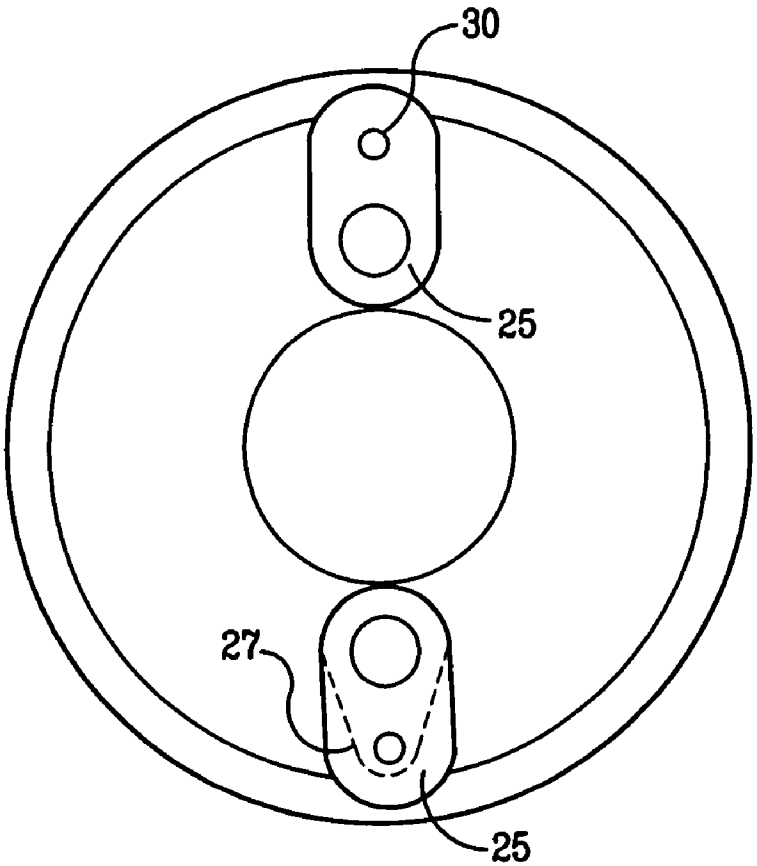

The preferred lobe is based on the type normally used in engines with a single overhead cam with rockers and inclined valves. Almost every automobile manufacturer makes an engine with this type of valve train. All these camshafts have very similar lobe profiles. These are characterised by having a low lobe lift in comparison to a large base circle diameter and asymmetrical profiles. This is necessary as the rocker ratio varies as the camshaft rotates. The rocker ratio is generally fairly high. This is necessary to give a useable amount of lift at the valve. Sometimes the lift at the valve is as much as twice the lobe lift. All of the above results in a lobe profile which is noticeably "rounded-off" or "snub-nosed" at its point of maximum lift. A typical profile of this type has about 20 degrees of angular span at the nose of the lobe which is very close to having the desired constant radius needed for use in a variable duration arrangement of the present invention.

It has been found that by grinding a small amount (typically 0.25 to 0.50 mm) off the nose of a production camshaft lobe and "blending-in" in the resulting constant radius area with the original profile a satisfactory overall profile can be achieved. In fact we have been able to use the same profile as that of a production camshaft with no apparent adverse effects. A typical general purpose car engine usually has a valve duration of about 250 crankshaft degrees. With a constant radius on the nose of the lobe of 20 degrees (40 crankshaft degrees) a variable duration range of 250 to 290 degrees is possible. Typically a general purpose road engine would not be able to make use of a duration greater than 290 degrees at maximum rotation speed. As the opening and closing areas of the profile remain identical to a standard profile, for that type of engine, and the lobe nose area is only slightly modified wear characteristics, noise are the same or very little different to a standard cam.

Generally, there is a very small window where all the possible parameters come together to produce a workable variable duration camshaft. The art of lobe design is a very critical one and even minor departures from established lobe profiles, that is departures for acceptable rates of lifter acceleration and deceleration and clearances, are likely to cause the mechanism using them to be unsuccessful. A characteristic of this invention is that generally the longer the "base" duration the greater the duration that can be achieved. This can be seen by using the 250 to 290 degree type of basic road cam as an example. If the 290 degree expanded shape was ground on to a lobe as the base or minimum profile, it would have a region of 40 degrees (80 crankshaft degrees) of constant radius which equates to a duration range of 290 to 370 degrees. Durations longer than 360 degrees are virtually unknown. Durations greater than 340 degrees are uncommon even in engines intended only for competition use and never in road use engines. A useable and useful variable duration cam intended only for competition use will have a range of something like 280 to 320 degrees with high lift without departing very much at all from traditional lobe shapes. There is no point in using the available 80 degree duration range. In a similar way it can be seen that the shorter the base duration the shorter the possible duration range is.

The preceding discussion may suggest that this invention is slightly better suited to competition or high performance road use rather than in low-revving industrial petrol engines or diesel engines. The diesel engine however is influenced much more from its camshaft than a petrol engine does. The diesel requires a camshaft with very short duration otherwise it will not generate enough compression pressure to ignite the injected fuel at cranking (starting) revolution speeds or idle speeds. The short duration cam needed seriously hampers the diesel at normal and higher running speeds. It can be seen that even though the diesel is not an ideal subject for this invention, it would probably benefit more from it than a petrol engine and may become the main recipient of camshafts of this type.

As soon as the lobes become even slightly misaligned, the majority of the profile becomes redundant as the follower does not touch it at all. The lobe insert or lobe modifying element uses the minimum amount of the total lobe outline possible which is from the start of the constant radius section to where the lobe base circle begins. The fixed valve lobe is typically mounted on an outer shaft and the lobe modifying elements are fixed to the inner shaft which is coaxial to the outer shaft. The relative angular displacement of the these two shafts is the means by which the duration is varied. If a basic duration of 250 degrees is used (125 camshaft degrees) this means that the minimum segment angular length is 62.5 plus 10 degrees=72.5 degrees. The prototypes have used a segment length of 90 degrees for simplicity and to allow for possible large basic durations more than 250 degrees. Other mechanisms of this type use all of the profile except the basic circle region. Some use the entire profile. Using only the minimum amount of profile on the lobe insert allows the structure to be much more compact and consequently stronger. The aperture in the outer shaft for the insert can be smaller and this weakens the outer shaft to a much lesser extent. It can also be seen that for similar reasons the full lobe profile on the outer shaft does not have to constitute the entire profile. However, for reasons of overall shaft strength and simplicity in manufacture, the complete profile has been used in the prototypes.

The typical method of manufacture and sequence of assembly is shown in FIGS. 1(*a*) to 1(*e*). The lobe segment can be arranged in two basic ways, centrally within the outer shaft lobe (FIG. 1*d*) or side-by-side (FIG. 1*e*). Generally, the centrally located lobe segment arrangement requires more width than the side-by-side arrangement. In a purpose designed cylinder head the centrally located segment is to be preferred as the loads on the follower are then symmetrical and there is likely to be more space to accommodate this arrangement. However, the side-by-side arrangement is probably perfectly satisfactory in most applications and because of space restrictions in some cases, it is the more suitable type of layout to use. Many production rockers have a much greater offset between cam lobe and valve stem than that which would result from a side-by-side arrangement of lobe and lobe insert. The outer shaft diameter is made as large as possible to maximise both its strength and that of the inner shaft.

Construction begins in a similar manner to a normal "billet" camshaft (that is, a cam basically machined from a solid piece or billet rather than cast or forged) except that the billet has a hole bored through its entire length. The diameter of this hole is of the order of 24 mm. This hole is for the inner shaft 1. The outer surface between the locations of where the lobes will be ground is turned to a typical diameter of about 32 mm giving a wall thickness of about 4 mm. This is the outer shaft (2). At appropriate intervals along the length of this hollow shaft are machined complete circles (3) of material about 14 to 22 mm wide and of a typical diameter of 48 to 55 mm. These annular sections (or "lobe blanks") are to become ultimately the cam lobes. Apertures (6) are then machined through the annular sections to the hole in the middle of the shaft. The location of the apertures, which will finally accommodate the lobe inserts, vary according to whether the lobe segments are contained wholly within the lobes as in FIG. 1(*d*) or side-by-side into the lobes as described in FIG. 1(*e*). FIG. 1(*d*) shows the full lobe FIG. 1(*d*) (1) (mounted on the outer shaft FIG. 1(*d*) (3) containing wholly the slot for the lobe insert (7) and its locating hole FIG. 1(*d*) (4) in the inner shaft FIG. 1(*d*) (5). Note that the full lobe's width FIG. 1(*d*) (6) tends to be greater than it does with the alternative arrangement shown in FIG. 1(*e*). Where FIG. 1(*e*) (7) is the lobe insert and FIG. 1(*e*) (8) the full lobe. The apertures are appropriately circumferentially disposed according to where the cam lobes will ultimately be located. In FIGS. 1(*a*), (*b*) and (*c*) for clarity the lobe inserts are shown completely separate from the cam lobes so the aperture is through the outer shaft only. The inner shaft (1) which runs the full length of the outer shaft (2) is closely fitted into the outer shaft (2). The fit is such that although close the inner shaft (1) can be rotated by hand inside the outer shaft (2). The inner shaft (1) has slots (4) and cylindrical holes (5) machined into it which line up with the apertures (6) in the outer shaft/lobe blanks (2)/(3). The segment blank (7) has a flat-sided section (8) and a cylindrical stem (9) the thickness of (8) being the same as the diameter of the stem (9), about 8 to 10 mm. The slots (4) and holes (5) in the inner shaft (1) are sized so that (8) and (9) are a tight fit in them when assembled. The sides (11) of the lobe segment blank are angled so that when assembled to the inner and outer shaft they butt up parallel to the edges of the aperture in the outer shaft/lobe blanks. The included angle between the sides is about 20 to 25 degrees less than the angular size of the aperture. This difference in angle is to allow the movement necessary for the variation of the duration. This basically means that it is the same or very similar to the angular span of area of constant radius on the lobe's nose. FIG. 1(*b*) shows the lobe segment tightly pressed or pressed and shrunk into the inner shaft through the outer shaft/lobe blank. After assembly a roll pin (12) is fitted in a hole drilled through the inner shaft (1) and lobe insert stem (9). Access to allow this drilling is through the circumferential gap (13) of 20 to 25 degrees which accommodates the relative allowable movement of the lobe and lobe segment.

FIG. 1(*c*) shows the assembly in its finished state after the grinding of the lobe and lobe segment combined profile. The grinding is done with the lobe and lobe segment locked in the position they are shown in FIG. 1(*c*), that is, the fully closed or minimum duration position. This is the preferred position in which the grinding is done. After the machining, assembly and grinding is completed the camshaft as a whole unit is surface hardened by nitriding for similar heat treatment. There are also several possible variations whereby the lobe segment could be bolted on and even be made removable. The material used for all components is 4140 or similar grade steel. Although all the prototypes so far have been fully machined there is no reason whey they cannot be at least in part cast or forged especially the outer shaft. There is also the possibility of using sintered powder technology for the lobe segments.

The outer shaft diameter is preferably only about 0.5 mm smaller than the cam lobe's base circle size. Camshafts with a very small shaft bearing diameter generally are not suited to being converted to a variable duration design. Other possible types can have a separate press-in or screw-in stem or lobe segment fixed by a bolt the head of which is later ground off to the correct profile. Most examples have a single piece lobe segment and stem as this allows the greatest stem diameter and overall strength but at the cost of being more difficult to make than other types. In normal applications the outer shaft with its fixed full lobes would lead as the cam rotated, the lobe inserts trailing.

As shown in the drawings, the leading, opening, lobe flank would be full width up to the point where the constant radius region begins, that is, where the aperture of the inset would be located. The object being that the stronger full face of the fixed lobe would be subjected to the inertial loads plus the load from the valve springs. The inserts are only subjected to valve spring loads which rapidly reduce as the normal lobe started to close.

Ideally the total width of the variable lobe would be double that of a normal lobe as used in that type of engine to ensure adequate surface area for the cam lobe follower to bear on. However this is rarely possible due to restrictions on space along the length of the camshaft. "Rarely possible" actually refers to the variable cam system when adapted to an existing production engine and cylinder head. In an engine (or cylinder head) designed specifically to employ this invention it would be much easier to find the required space—especially in twin cam types. This lack of space suggests that the use of a needle-roller bearing follower may be advantageous rather than the much more common sliding type of follower. For the same width roller bearing can withstand greater loads than a sliding type of follower. Even though the prototype engine performed well with the normal sliding type of follower it is expected that the roller follower will be employed in many cases.

It was stated earlier that, although, this particular invention was aimed at the S.O.H.C./ with rockers type of engine, has potential application to all types of valve gear layouts. However, it does suit engines that utilise rockers in their valve train especially those which have a high rocker ratio more than engines that do not have rockers. Thus, overhead cam engines where the valves are directly actuated (via inverted bucket tappets etc) by the camshaft lobes are not very suited to this variable duration camshaft invention. In this type of valve layout the lobe lift is equal to the valve lift. This means that for a reasonably short duration profile (250 degrees for example) the lobe must have a very "pointy" nose—that is a nose with a very short angular span. The only way to obtain a useable span of constant nose radius is to use a camshaft of very large physical size—which is possible but somewhat awkward in practice. To best make use of this invention in an engine with double overhead camshafts short "finger" rockers would usually be needed with an without a roller bearing. Production engines using this type of layout (but with conventional camshafts) are becoming increasingly common in both car and motorcycle engines.

The twin-cam layout has certain advantages compared to a single cam system when used with variable duration camshafts. The basic one is that the rate of increase need not be the same for both intake and exhaust valves. With a single cam the rate of increase must be the same for both the intake and exhaust valves. Another important advantage with a twin cam layout is that the valve overlap, the period when both intake and exhaust valves are open, can be varied independently of the duration variation by the relative rotational displacement of the camshaft with respect to the crankshaft. Many production twin-cam engines already have this capability, usually referred to as 'variable camshaft timing', the duration being fixed. If the variable duration camshaft is being used in an application where the main objective is throttle-free engine load control by the late closing of the intake valve, then the layout should be twin can unless the exhaust valve duration is to be fixed in which case a single can system could be used. The now somewhat old-fashioned pushrod operated overhead valve type of engine is generally suited to employ this invention as it has rockers in its valve train. The added inertia of the pushrods, etc, plus the need for fairly high rates of lobe lift, necessary to obtain the desired length of constant radius, and lack of space along the camshaft, especially in "V" type engines, would probably require needle roller bearing cam lobe followers. The pushrod-type engines may be slightly obsolescent but this type of engine is still manufactured in large numbers. Many of these engines, especially the higher performance versions, are equipped with roller Lifters as standard. The typical roller cam profile used in these engines has the desired blunt lobe nose profile which is very similar in shape to the previously described SOHC types but is symmetrical.

The methods of control of the duration in the prototype is by a simple centrifugal mechanism which both controls the appropriate amount of duration for a particular rpm, and actuates the duration change. At the front end, that is, the drive end, of the camshaft both the inner and outer shafts are attached to respective drive flanges. The centrifugal mechanism controls and actuates the relative angular position of these two flanges thereby adjusting the duration of the camshaft. In this example the full lobes advance the same amount that the lobe segments retard which means that the overall centerline of the combined lobe does not change as the duration changes.

The mechanism shown in FIGS. 2(*a*), (*b*) and (*c*) are drawings of the device used successfully on the prototype camshaft. This mechanism holds the duration unchanged at 250 degrees from idle to about 3000 rpm, the point of maximum torque of the base 250 degree profile. The static tension on the return spring and the position of the spring's anchorage points, and thus, the amount of leverage of the spring) determines the point at which the duration starts to increase. Above 3000 rpm the duration increases in a roughly linear manner with the rpm until it reaches a maximum of 290 degrees at 6000 rpm. Computer simulations of the test engine have shown that there is little or no gain in power or torque by varying the duration in anything but a linear manner with the rpm. In actual testing it is not really noticeable if the increase in duration is not strictly linear with the rpm but is only roughly so.

Referring to FIGS. 2(*a*), 2(*b*), 2(*c*), 2(*d*), 2(*e*), 2(*f*) and 2(*g*) show the component parts of the centrifugal mechanism as used on the prototype variable duration camshafts. FIG. 2(*a*) and 2(*b*) are the front views of the mechanism showing the centrifugal weights (15) which are mounted on the front of the assembly. FIG. 2(*a*) is the fully closed-up position (or minimum duration) and 2(*b*) is the fully open (or maximum duration) position. The centrifugal weights are fixed to shafts FIG. 2(*a*) (16) by locking pins FIG. 2(*b*) (17) which are pivoted in holes FIG. 2(*c*) (18) in the timing belt pulley. The centrifugal weights return spring is FIG. 2(*a*) (19) the alternative spring anchoring points are shown in FIG. 2(*a*) (20) and the weights limit of travel stop pins are FIG. 2(*b*)(21). Drive pins FIG. 2(*a*)(22) in the weights engage in slots FIG. 2(*d*)(23) in the front drive flange FIG. 2(*d*) which is keyed to the inner shaft. The timing belt pulley drawing FIG. 2(*c*) shows the holes FIG. 2(*c*)(18) for the centrifugal weight pivot shaft. The timing belt pulley has a hole in tis centre FIG. 2(*c*)(24) which fits over a rearward extension of the front drive flange and thus rotably partly locates the timing belt pulley. The centrifugal weight pivot shafts extend through to the rear of the assembly where they are connected to levers FIG. 2(*f*)(25) locked to the pivot shaft by pins FIG. 2(*g*)(26). A possible alternative shape for the levers is shown in dashed lines in FIG. 2(*f*)(27). A degree scale for test purposes is FIG. 2(*c*)(28) and the timing mark is FIG. 2(*c*)(29). Drive pins in the levers FIG. 2(*f*)(30) engage in slots FIG. 2(*e*)(31). In the rear drive flange FIG. 2(*e*) and FIG. 2(*g*). The rear drive flange is keyed to the outer shaft. Elongated holes in the drive flanges FIG. (2(*d*)(32) allow for the relative movement of the flanges and the pivot shaft.

Arrows FIGS. 2(*d*) and 2(*e*) (33) indicate direction of camshaft rotation and arrows FIGS. 2(*d*) and 2(*e*) (34) indicate the direction of flange movement to increase duration. The basic operating principle is as follows. The driving force from the crankshaft is applied to the camshaft belt pulley via the timing belt. This driving force is then applied to the centrifugal weight pivot shaft where it passes through the timing belt pulley. The driving force is then transferred to the drive pins that engage the front and rear drive flanges. The drive pins are offset from the pivot shaft centre of rotation in such a fashion that any rotation of the pivot shaft causes the front and rear drive flanges to move through equal angles but in opposite directions. This is equivalent to saying that the main driving force or torque for the pivot shaft is split into two equal but opposed forces or torques applied to the front and rear drive flanges. The balancing of these two forces was one of the main objectives in the design of the centrifugal mechanism as it allows the actual forces needed to effect duration changes to be very small relative to the force needed to drive the camshaft as a whole. Each of the two weights is linked in the same manner to both drive flanges. As the engine rpm increases above about 2500 or 3000 rpm the static tension on the return spring is overcome by the centrifugal force on the weights and they begin to move outwards thereby rotating the pivot shaft and increasing the duration of the camshaft. Most of the centrifugal force on the weights (of the order of 100 kilograms when the weight limit pins are reached) is used to overcome the return spring tension, very little force is needed to actually change the duration. These large forces compared to actual forces needed to perform the duration change mean that the response time of the duration change when the rpm changes is very fast. In fact there is no discernible time lag in the duration increase or decrease when the rpm varies either up or down.

One of the main aims of the centrifugal system was to make the control and actuating mechanism totally self-contained and not reliant on separate hydraulic pumps, electronics, etc. This is especially important if the variable duration camshaft is being fitted to an existing production engine as an aftermarket item but somewhat less so if the system is being applied to a purpose designed engine/cylinder head. Another important object in the design of the centrifugal mechanism was to link the inner and outer shafts together in such a way that the force needed to drive the advancing lobe is balanced against the force needed to drive the trailing lobe insert, a small force only being needed to increase and decrease the duration. In the testing of the prototype engine this was proven to be the case. Without the return spring fitted the weights move outwards, and increase the duration, as the engine speed rises but when the engine returns to idle the weights slowly return to the closed-up or minimum duration position showing that the force needed to drive the inner and outer shafts are indeed fairly well balanced against each other.

In alternative prototypes the centrifugal mechanism, the weights, springs, etc, can be completely contained within the camshaft drive belt pulley or chain sprocket—as shown in FIGS. 2(*a*) and (*b*). This is partly for reasons of safety because if the mechanism failed at high speed, pieces could fly dangerously in all directions. Another proposed improvement is to have the drive to the inner and outer shaft flanges to be by pins engaging curved slots in the flanges. The object of this is to both lower the pin-to-slots wear loads and by changes to the shape of the slots (and/or return spring rates) tailor the rate of increase of duration with rpm to suit particular applications.

Figure 3B:
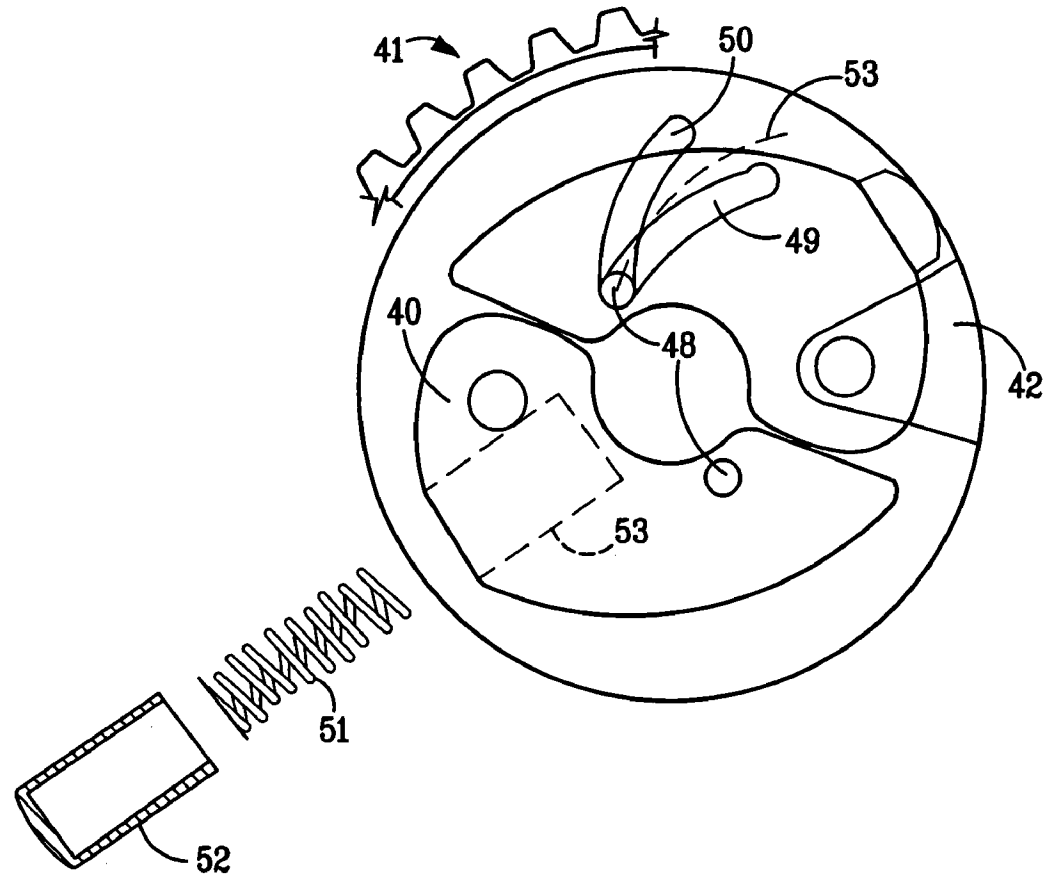
FIGS. 3(*a*) and 3(*b*) are schematic views of alternative camshaft arrangements.
Figure 3A:
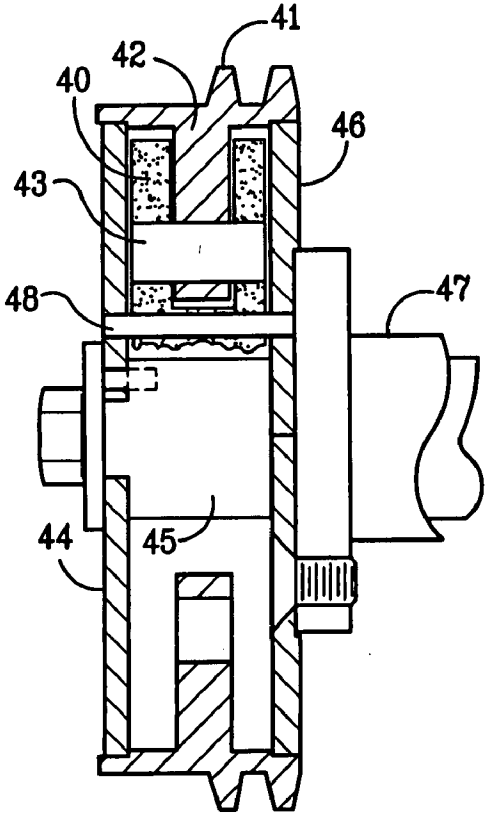

An alternative mechanism is shown in FIGS. 3(*a*) and 3(*b*) which has the same basic aims as the one described in FIG. 2 such as the balancing of opposing forces etc. but has it similar principal components arranged into a more suitable design for possible production purposes. The main components are the centrifugal weights (40), the outer casing (41) which carries in this sketch a double row chain sprocket and protruding inwards form the casing is a tongue (42). This tongue (42) carries the centrifugal weights pivot shaft (43). The front drive flange (44) is attached to the inner shaft (45) and the rear drive flange (46) is fixed to the outer shaft (47)

by screws. The flange drive pin (48) located in the weight protrudes at both ends into curved slots (49) in the front drive flange and (50) in the rear flange (shown here superimposed for clarity). There are two return springs (51) which are contained in cylindrical casings (52) located in holes (53) bored in the weights. The travel on the weights is limited by the inside surface of the outer casing rathe than by stop pins as previously. The general operating principle is very similar to the previous design, the main difference being the slots in the drive flanges. The curved dashed line (53) indicates the position of a slot whose centre of curvature is the pivot shaft. If there was a slot in this position movement of the drive pin in the slot would cause no displacement of the drive flange. By having slots as indicated by (49) and (50) which have the same starting point and radius but different centres of curvature the appropriate amount of relative movement in the front and rear flanges could be achieved. Variations in the shape of the slots such as straightening or tightening of the curvature (depending on which flange it is) in its outer end could be used to compensate for the excessive duration increase in the upper rpm range. Generally speaking, the shape of the slot can be tailored to give whatever characteristics are desired more easily than with the previous type of mechanism. The return springs are of the compression type rather than the extension type used previously. Compression springs are preferable in this type of application as they are less likely to break if over stressed and they can also be more easily made to have rising spring rates. This newer design also differs from the earlier one in that the sprocket wheel/outer casing is rotatably supported on the edges of the drive flanges whereas in the earlier design the timing belt pulley (the equivalent structure) was supported at its centre on the rearward extension of the front drive flange which in turn was mounted on the inner shaft.

Since modifications within the spirit and scope of the invention may be readily effected by persons skilled in the art, it is to be understood that the invention is not limited to the particular embodiment described, by way of example, hereinabove.

The invention claimed is:

1. A variable duration valve timing camshaft comprising:

an inner shaft;

an outer shaft;

at least one cam assembly having a fixed cam lobe and a lobe modifying segment, the fixed cam lobe being mounted on the outer shaft for rotation therewith and having an angular aperture of a first angle therein, the lobe modifying segment subtending a second angle, smaller than the first angle, and being mounted on the inner shaft for angular movement therewith within said angular aperture; and means to angularly move the inner shaft relative to the outer shaft so as to move the lobe modifying segment relative to the fixed cam lobe between a first position in which the duration of the camshaft is the duration of the fixed cam lobe and a second position in which the lobe modifying segment protrudes from the profile of the fixed cam lobe to increase the duration of the cam assembly from that from that of the fixed cam lobe.

2. The camshaft of claim 1, wherein the first angle is approximately 20–25 degrees larger than the second angle.

3. The camshaft of claim 1, wherein the aperture is longitudinally positioned on one side of the fixed cam lobe.

4. The camshaft of claim 1, wherein the aperture is longitudinally positioned approximately centrally within the fixed cam lobe.

5. The camshaft of claim 1, wherein the fixed cam lobe has the leading, opening lobe flank and a trailing, closing lobe flank and the aperture is angularly positioned on the trailing, closing lobe flank.

6. The camshaft of claim 1, further including a plurality of cam assemblies mounted for common movement on the inner shaft and the outer shaft.

7. The camshaft of claim 5, wherein the means to move the inner shaft relative to the outer shaft is a centrifugal mechanism.

8. The camshaft of claim 5, wherein the centrifugal mechanism is adapted to increase the duration of the cam assembly from that from that of the fixed cam lobe in response to increases in the rotational speed of the camshaft assembly.

9. A method of varying the duration valve timing of a camshaft, the camshaft comprising:

an inner shaft;

an outer shaft; and at least one cam assembly having a fixed cam lobe and a lobe modifying segment, the fixed cam lobe being mounted on the outer shaft for rotation therewith and having an angular aperture of a first angle therein, the lobe modifying segment subtending a second angle, smaller than the first angle, and being mounted on the inner shaft for angular movement therewith within said angular aperture, the method comprising the step of angularly moving the inner shaft relative to the outer shaft so as to move the lobe modifying segment within relative to the fixed cam lobe between a first position in which the duration of the camshaft is the duration of the fixed cam lobe and a second position in lobe modifying segment protrudes from the profile of the fixed profile cam to increase the duration of the camshaft assembly from that of the fixed cam lobe.

10. The method of claim 1, wherein the increase in the duration of the cam assembly from that from that of the fixed cam lobe is in response to increases in the rotational speed of the camshaft assembly.

* * * * *